United States Patent [19]

Ekshtut

[11] 4,367,664

[45] Jan. 11, 1983

[54] COMBINATION TOOL

[76] Inventor: Leonid Ekshtut, 1520 16th Ave., Apt. #6, Seattle, Wash. 98122

[21] Appl. No.: 230,680

[22] Filed: Feb. 2, 1981

[51] Int. Cl.[3] ..... B25B 15/00

[52] U.S. Cl. ..... 81/436; 81/460; 81/461; 81/439; 81/121 A; 411/410; 411/427

[58] Field of Search ..... 81/436, 437, 439, 441, 81/460, 461, 186, DIG. 11, 121, 122; 411/410, 427

[56] References Cited

U.S. PATENT DOCUMENTS

| | | | |
|---|---|---|---|
| 445,451 | 1/1891 | Miller . | |
| 499,863 | 6/1893 | Walker et al. . | |
| 518,328 | 4/1894 | Oakey . | |
| 1,933,007 | 10/1933 | Dieter | 411/427 |
| 2,173,707 | 9/1939 | Brown | 81/460 |
| 2,375,249 | 5/1945 | Richer | 411/410 |
| 2,912,890 | 11/1959 | Robinson | 81/441 |
| 3,216,302 | 11/1965 | Kluth | 411/427 |
| 4,079,643 | 3/1978 | Evans | 81/439 |

FOREIGN PATENT DOCUMENTS

| | | | |
|---|---|---|---|
| 1298949 | 7/1969 | Fed. Rep. of Germany | 81/436 |
| 2107751 | 2/1971 | Fed. Rep. of Germany . | |
| 1326010 | 8/1973 | United Kingdom | 81/439 |

*Primary Examiner*—Donald R. Schran
*Attorney, Agent, or Firm*—Graybeal & Uhlir

[57] ABSTRACT

An insert type drive tool (20) is configured to be insertable within both a square-shaped cavity (32) and a hexagonal shaped cavity (40) of the same size. In cross section shank (24) of tool (20) includes a pair of major sides (26) disposed in spaced parallel relationship to each other, and a pair of minor sides (28) also disposed in spaced parallel relationship to each other. The minor sides (28) are disposed substantially perpendicularly to the major sides (26) and are spaced apart from each other substantially the same distance separating the major sides (26). Two pairs of intermediate sides (30) extend diagonally from each end of major sides (26) at an angle of approximately 120° to intersect an adjacent end of a corresponding minor side (28).

4 Claims, 9 Drawing Figures

COMBINATION TOOL

DESCRIPTION

1. Technical Field

The present invention relates to tools, and more particularly to insert type drive tools which are capable of snugly engaging within both square and hexagonally shaped cavities and also to sockets which are capable of closely engaging with both square and hexagonally shaped capscrew heads, nuts and other types of hardware.

2. Description of the Prior Art

Sockets, socket wrenches for the sockets, box wrenches and allen type insert wrenches are commonly used by many individuals, from professional mechanics, machinists, plumbers, and electricians to weekend handymen, to loosen or tighten capscrews, nuts, threaded plugs or similar types of threaded hardware members. The most commonly shaped nuts are either of square or hexagonal shape. Also, the most commonly encountered types of capscrews have either a square or hexagonally shaped head or a circularly shaped head with a square or hexagonally shaped socket formed in the head. Presently different types of allen type insert wrenches must be used in conjunction with capscrews having square and hexagonal cavities. Also, in the present state of the art, sockets having square openings are limited to use with square headed capscrews and nuts while separate sockets having hexagonal cavities must be used in conjunction with capscrews and nuts of hexagonal shape. As a consequence, workmen must purchase not only two separate sets of sockets, but also two separate sets of allen type insert wrenches, thus requiring a very large investment in tools. The high cost of purchasing dual sets of tools while even very expensive for professional workmen, may be prohibitive for the average handyman who may have only occasional need for the tools. Thus, applicant has perceived a need for sockets, keys and insert wrenches which are capable of being used with both square and hexagonally shaped hardware.

In known types of insert wrenches, a different shaped insert key must be used for each different shape of cavity encountered. As illustrated in German Offenlegangsschrift No. 2,107,851, a hex-shaped key must be for a hex-shaped cavity, a square-shaped key must be used for a square cavity, and a triangularly shaped key must be used for a triangular shaped cavity.

U.S. Pat. Nos. 499,863 and 518,328 disclose eight-point box wrenches which are designed for use with square-shaped nuts and bolts. As stated in U.S. Pat. No. 518,328, if a hexagonal nut or bolt is to be tightened or loosened, a different shaped wrench must be used. In U.S. Pat. No. 499,863 the opening in the box wrench is generally square-shaped to engage over a nut or bolt of a particular size. Right angle grooves are formed in the middle of each of the four sides of the wrench to receive a smaller sized nut or bolt.

Miller U.S. Pat. No. 445,451 discloses a socket wrench in which the socket is designed to be used in conjunction with four different sized square nuts or bolts. The socket has a larger upper section and a smaller lower section. The upper section is formed generally in a square to engage with the largest size nut. Four right angle grooves are formed in each side wall of the upper section to engage with the next largest size nut. The lower section is also formed in a generally square-shape to engage with a third largest size nut. A right angle shaped groove is also formed in the middle of each of the lower section walls to engage with a smallest size nut. Although both the upper and lower sections have eight points or corners, the sockets disclosed in U.S. Pat. No. 445,451 are only designed to be used in conjunction with sqaure-shaped nuts and bolts.

DISCLOSURE OF THE INVENTION

The present invention relates to tools which can be used to tighten and loosen hardware having either a square or hexagonal outer shape or a square or a hexagonal shaped cavity, such as the cavity of a socket head capscrew. Accordingly, one aspect of the present invention includes an insert type drive tool which is insertable within both square and hexagonal shaped cavities of the same size. The drive tool includes an eight sided shank portion which in cross section includes a pair of major sides disposed in spaced parallel relationship and a pair of minor sides also disposed in spaced parallel relationship to each other but in a direction substantially perpendicular to that of the major sides. The distance separating the minor sides is substantially equal to the distance separating the two major sides. Moreover, the shank section includes two pairs of diagonally disposed intermediate sides which extend diagonally from each end of each major side at an angle of approximately 120° to intersect an adjacent end of a corresponding minor side to thereby complete the eight sided shape of the drive tool shank. The particular intermediate sides which extend diagonally from opposite ends of opposed major sides are disposed in spaced parallel relationship to each other and are separated from each other by a distance substantially equal to the distance separating the two major sides. By this particular consturction of the shank portion, the insert type drive tool can be inserted within both a square opening and a hexagonal shaped opening of the same size thereby eliminating the need for two separate tools to drive hardware items formed with square and hexagonal shaped cavities.

According to another aspect of the present invention, drive tools, such as sockets and box wrenches, are formed with a cavity or opening designed to engage over nuts and bolt heads of either square, hexagonal or twelve-point shape. The socket cavity or wrench opening is generally square in cross section as formed by four walls of equal length which define four substantially right angle corners. A V-shaped groove of approximately 120° bisects each of the side walls forming the cavity or opening. To permit the sockets or box wrench to engage with square or hexagonal shaped nuts or bolt heads of the same size, the V-shaped grooves must be of a particular size, i.e. the distance separating the apexes of oppositely disposed grooves must be approximately 1.15 times the length of each of the side walls.

BRIEF DESCRIPTION OF THE DRAWINGS

The details of typical embodiments of the present invention will be described in connection with the accompanying drawings, in which.

BEST MODE OF THE PRESENT INVENTION

Figure 1:
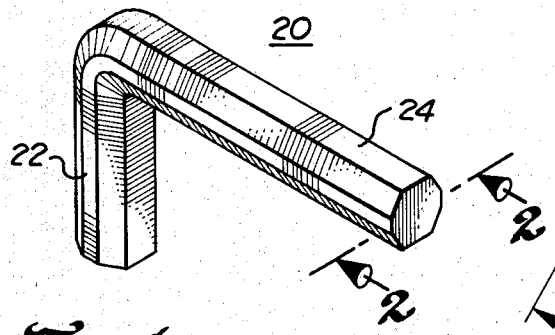
FIG. 1 is an isometric view of a typical insert type drive tool constructed according to the present invention.
Figure 2:
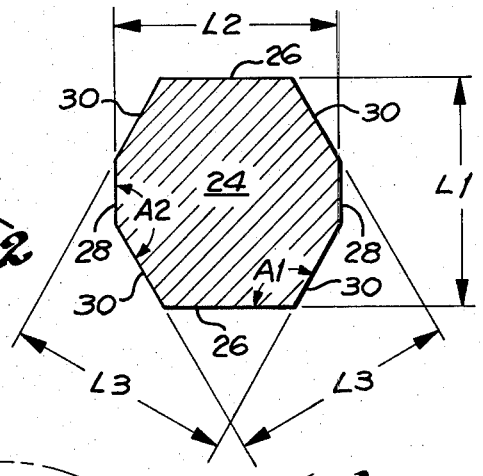
FIG. 2 is a cross-sectional view of the shank portion of the insert type drive tool illustrated in FIG. 1.

Referring initially to FIG. 1, an insert type drive tool 20 constructed according to the best mode of the present invention presently known to applicant is illustrated as formed in an L-shape with a short shank portion 22 and a long shank portion 24 so that either end of the tool may be inserted within both a square-shaped or hexagonal-shaped cavity of the same size, such as a cavity typically formed within the head of a socket head capscrew. Referring additionally to FIG. 2, in cross section shank 24, and thus also shank 22, is constructed from eight flat sides including a pair of major or longest sides 26 which are disposed relative to each other in spaced parallel relationship and a pair of minor or shortest sides 28 also disposed relative to each other in spaced parallel relationship. Major sides 26 are disposed transversely to minor sides 28 and are spaced apart from each other a distance L1 which is equal to the distance L2 separating minor sides 28 from each other. Shank 24 also includes intermediate sides 30 which extend diagonally from each end of each major side 26 to intersect with a corresponding end of a minor side 28 to from fairly sharp corners with the major and minor sides. Intermediate sides 30 are disposed at an angle A1 of approximately 120° relative to major sides 26. Correspondingly, since minor sides 28 are disposed perpendicularly to major sides 26, the angle A2 separating intermediate sides 30 from minor sides 28 is by necessity 150°. Diametrically opposite intermediate sides 30, i.e. the pairs of intermediate sides extending diagonally from opposite ends of opposed major sides 26, are disposed in spaced parallel relationship to each other and are separated from each other by a distance L3 which is substantially equal to both L1 and L2.

Figure 3:
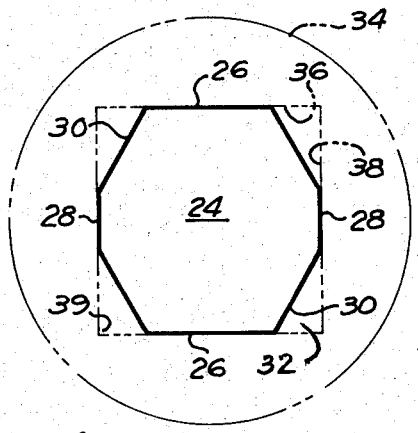
FIG. 3 is an enlarged cross-sectional view of the insert type drive tool illustrated in FIGS. 1 and 2 shown engaged within a square-shaped cavity.

Next referring to FIG. 3, insert tool 20 is illustrated as engaged within a square-shaped cavity 32 such as the type commonly formed in the head of a capscrew such as socket head capscrew 34 or other type of hardware member, such as a threaded plug, not shown. Shank 24 is sized to fit closely and snugly within cavity 32 in such a manner that major sides 26 are disposed adjacent opposite sides 36 of the cavity while minor sides 28 are disposed adjacent the other two sides 38 of the cavity. Intermediate sides 30 of tool 20 extend diagonally across the corner portions 39 of cavity 32. Because the distance L1 separating major sides 26 is equal to the distance L2 separating minor sides 28, shank 24 fits closely and snugly within cavity 32 to thereby prevent tool 20 from turning within the cavity. As a consequence, tool 20 is capable of sufficiently and effectively loosening or tightening screw 34 as desired.

Figure 4:
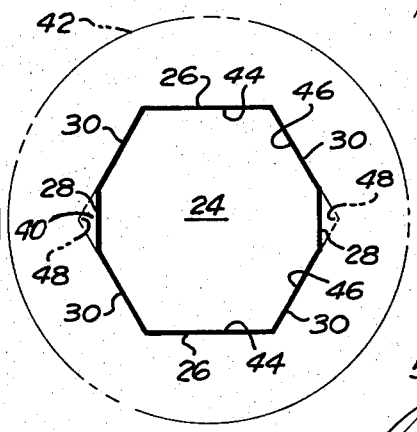
FIG. 4 is an enlarged, cross-sectional view of the insert type drive wrench illustrated in FIGS. 1 and 2, shown engaged with a hexagonal shaped cavity.

Next referring to FIG. 4, drive tool 20 is illustrated as inserted within a hexagonal shaped cavity 40, such as the type commonly formed in various hardware items, such as socket head capscrew 42. The width of cavity 40 is substantially the same as the width of square cavity 32 shown in FIG. 3, so that when shank portion 24 is inserted within the cavity, major sides 26 extend along the full length of cavity sides 44 while intermediate sides 30 extend along almost the full length of cavity sides 46. Shank minor sides 28 span across cavity corners 48. Thus, it can be appreciated that shank 24 closely and snugly occupies almost the entire volume of cavity 40 to thereby minimize the likelihood that tool 20 will rotate relative to capscrew 42, even when a large torque load is applied to the capscrew.

It is well known that a typical square-shaped insert type tool, not shown, which is designed to engage within a square cavity such as 32 is not capable of engaging within hexagonal shaped cavity such as 40. Also a typical hexagonal shaped insert type tool, not shown, which is designed to fit within a hexagonal shaped cavity such as cavity 40 is not capable of engaging within a square cavity such as cavity 32. As a consequence, separate tools must be utilized for each of these two types of cavities. Applicant's invention, on the other hand as described above, is capable of snugly and closely engaging within both square cavity 32 and hexagonal cavity 40 thereby eliminating the need for and expense of two different types of tools.

It is to be understood that the present invention can be used in conjunction with insert type drive tools other than the particular tools 20 described above. For instance, a shank such as shank 24 can be affixed to a handle such as that used in a typical screwdriver. Also, a shank such as shank 24, can be affixed to a transverse or T-type handle which is designed to fit across the palm of the hand.

Figure 5:
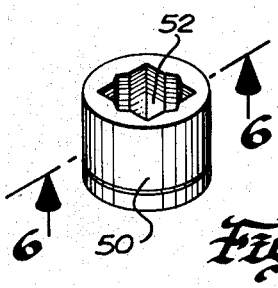
FIG. 5 is an isometric view of a typical socket constructed according to the present invention.
Figure 6:
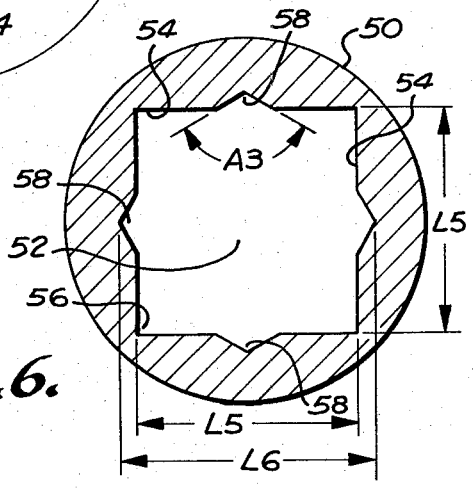
FIG. 6 is an enlarged cross-sectional view of the socket illustrated in FIG. 5.

Referring next to FIGS. 5 and 6, illustrated is a generally cylindrically shaped socket 50 also constructed according to the best mode of the present invention currently known to applicant. Socket 50, which is designed to be used in conjunction with a typical ratchet type wrench, not shown, includes a specifically shaped cavity 52 which is adapted to receive square, hexagonal or 12-point shaped nuts, bolts and other similar types of hardware members of the same size, as described more fully below. In cross section, cavity 52 is generally square shaped and formed by four side walls 54 of equal length L5 which define four perpendicular corners 56. Each side wall 54 is bisected by an angle-shaped groove 58 disposed in the middle of the side wall. Each groove 58 is formed in an angle A3 of approximately 120°. The distance L6 separating the apexes of diametrically opposed groove 58 is approximately 1.15 times the length L5 of side walls 54.

Figure 7:
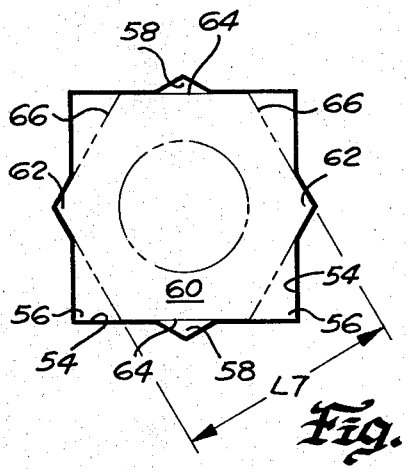
FIG. 7 is an enlarged cross-sectional view of the socket illustrated in FIGS. 5 and 6 shown engaged over a hexagonal shaped capscrew head.

Referring next to FIG. 7, socket 50 is illustrated as engaged over a hexagonal capscrew head 60 having a width L7 which is equal to the length L5 of side wall 54. Two diametrically opposed corners 62 of capscrew head 60 are disposed within corresponding grooves 58 while the two opposed sides 64 of capscrew head 60 not associated with corners 62 extend along a central portion of corresponding side walls 54 to span across grooves 58 formed in these particular side walls. The sides 66 of capscrew head 60 which together define corners 62 span diagonally across corners 56 of cavity 52. The snug fit of capscrew head corners 62 within corresponding grooves 58 and the close adjacency of capscrew head sides 64 with corresponding cavity side walls 54 ensures that socket 50 will not twist relative to the capscrew head. It is to be appreciated the close fit between capscrew head corners 62 and grooves 58 is the result of forming the grooves at the same angle as the angle of capscrew head corners 62 and also the result of sizing grooves 50 so that the distance separating the apexes of the grooves correspond to the distance across the diametrically opposed capscrew head corners 62.

Figure 8:
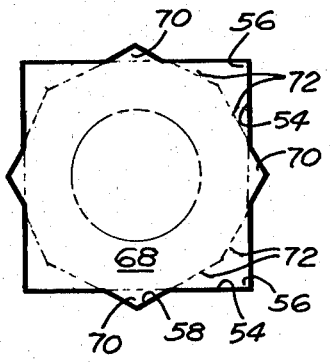
FIG. 8 is an enlarged cross-sectional view of the socket illustrated in FIGS. 5 and 6 shown engaged over a twelve-point capscrew head.

FIG. 8 illustrates socket 50 as engaged over a 12-point capscrew head 68. Four orthogonally related sides 70 of capscrew head 68 extend along corresponding side walls 54 of cavity 52 to span across the groove positions 58 of the cavity side walls. Pairs of adjacent sides 72 of capscrew head 68, which are disposed between capscrew head sides 70, span across each corner 56 of cavity 52. The close fit between capscrew head sides 70 and socket side walls 54 prevent socket 50 from turning relative to the capscrew head even if high torque loads are applied to the capscrew head.

Figure 9:
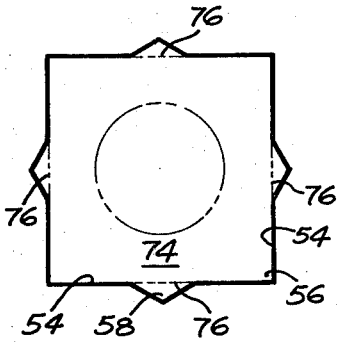
FIG. 9 is an enlarged cross-sectional view of the socket illustrated in FIGS. 5 and 6, shown engaged over a square-shaped capscrew head.

In FIG. 9, a square-shaped capscrew head 74 of the same width as the width of capscrew heads 60 and 68 illustrated in FIGS. 7 and 8 is depected as engaged within the socket 50. The sides 76 of capscrew head 74 extend along corresponding side walls 54 of cavity 52, and thus the capscrew head occupies substantially the entire volume of cavity 52. Accordingly each capscrew head side 76 spans across a groove 58. The lack of contact of socket 50 with capscrew head sides 76 in the region of grooves 58 should have very little if any effect on the ability of socket 52 to transfer maximum torque loads to the capscrew head.

It is to be appreciated that a typical square shaped socket, not shown, which is designed to engage over a square shaped capscrew or nut, cannot be used to engage over a hexagonal shaped capscrew or nut of the same size as the square capscrew or nut. Thus, a differently shaped socket is needed to tighten and loosen such hexagonally shaped capscrews and nuts. Moreover, it is also clear that a socket having a hexagonally shaped cavity for receiving a hexagonally shaped nut or bolt is not capable of it snugly fitting over a square shaped nut or bolt of equal size. However, applicant's socket 50 as described above is capable of being used in conjunction with not only square and hexagonally shaped capscrews and nuts, but also 12-point capscrews and nuts of the same size. The universal usage of socket 50 is made possible by the precise relationship between the location, angle and size of grooves 58 relative to the length of side walls 54, as set forth above.

It is to be understood that the cross-sectional shape of cavity 52 is not limited to use to only sockets such as socket 50, but it also can be advantageously used in box-type wrenches to thereby limit the need for individual box-wrenches having either square shaped openings or hexagonal shaped openings. Moreover, a cavity having a cross-sectional shape corresponding to the cross-sectional shape of cavity 52 as illustrated in FIG. 4 can also be formed in the end of socket 50 opposite cavity 52 to thereby receive either a square or hexagonal shaped drive lug of a ratchet wrench, not shown.

As will be apparent to those skilled in the art to which the invention is addressed, the present invention may be embodied in forms or embodiments other than that specifically disclosed above, without departing from the spirit or essential characteristics of the invention. The particular embodiments of the insert-type drive tool 20 and socket 50 described above are therefore to be considered in all respects as illustrative, and not restrictive, i.e. the scope of the present invention is set forth in the appended claims rather than being limited to the examples of the drive tool 20 and socket 50 set forth in the foregoing description.

What is claimed is:

1. A drive tool insertable within both square and hexagonal shaped cavities of corresponding size, said drive tool comprising a shank portion which in cross section includes at least eight sides, with:

a pair of major sides disposed in spaced parallel relationship;

a pair of minor sides disposed in spaced parallel relationship in a direction substantially perpendicular to said major sides; and two pairs of intermediate sides extending diagonally from each end of said major sides at an included angle of approximately 120° to intersect an adjacent end of a corresponding minor side.

2. A drive tool according to claim 1, wherein said minor sides are spaced apart from each other a distance substantially equal to the distance separating said major sides.

3. The drive tool according to claim 1, wherein said minor sides are of a length less than one-half of the length of said major sides.

4. A drive tool according to claim 1, wherein said intermediate sides which extend diagonally from opposite ends of opposed major sides are disposed in spaced parallel relationship to each other and are separated by a distance substantially equal to the distance separating said two major sides.

* * * * *